US008657039B2

(12) United States Patent
Radford et al.

(10) Patent No.: US 8,657,039 B2
(45) Date of Patent: Feb. 25, 2014

(54) RESTRICTION ELEMENT TRAP FOR USE WITH AN ACTUATION ELEMENT OF A DOWNHOLE APPARATUS AND METHOD OF USE

(75) Inventors: Steven R. Radford, The Woodlands, TX (US); Kevin G. Kidder, Carencro, LA (US)

(73) Assignee: Baker Hughes Incorporated, Houston, TX (US)

( * ) Notice: Subject to any disclaimer, the term of this patent is extended or adjusted under 35 U.S.C. 154(b) by 426 days.

(21) Appl. No.: 11/949,405

(22) Filed: Dec. 3, 2007

(65) Prior Publication Data

US 2008/0128169 A1 Jun. 5, 2008

Related U.S. Application Data

(60) Provisional application No. 60/872,744, filed on Dec. 4, 2006.

(51) Int. Cl.
*E21B 10/32* (2006.01)

(52) U.S. Cl.
USPC ..... 175/268; 166/318

(58) Field of Classification Search
USPC ..... 175/268, 269, 237, 243; 166/318
See application file for complete search history.

(56) References Cited

U.S. PATENT DOCUMENTS

| | | | |
|---|---|---|---|
| 1,548,578 | A | 8/1925 | Blanchard |
| 1,678,075 | A | 7/1928 | Phipps |
| 1,772,710 | A | 8/1930 | Denney |
| 1,804,850 | A | 5/1931 | Triplett |
| 1,906,427 | A | 5/1933 | Sievers et al. |
| 2,069,482 | A | 2/1937 | Seay |
| 2,177,721 | A | 10/1939 | Johnson et al. |
| 2,344,598 | A | 3/1944 | Church |
| 2,754,089 | A | 7/1956 | Kammerer, Jr. |

(Continued)

FOREIGN PATENT DOCUMENTS

| | | | |
|---|---|---|---|
| EP | 246789 | A2 | 11/1987 |
| EP | 0594420 | A1 | 4/1994 |

(Continued)

OTHER PUBLICATIONS

PCT International Search Report for International Application No. PCT/US2007/024795, mailed May 28, 2008.

(Continued)

*Primary Examiner* — Giovanna Wright
*Assistant Examiner* — Kipp Wallace
(74) *Attorney, Agent, or Firm* — TraskBritt

(57) ABSTRACT

A downhole apparatus for engaging a borehole in a subterranean formation includes a tubular body having a longitudinal axis and a first bore, an actuation element having a second bore and is positioned within the first bore of the tubular body, a drilling fluid flow path extending through the first and second bores, and a restriction element trap positioned within the second bore of the actuation element. The actuation element is configured to selectively retain an operable component of the downhole apparatus in an initial position and the restriction element trap is configured for retentively receiving a restriction element. A restriction element trap for use with an actuation element for retentively receiving a restriction element and an expandable reamer apparatus for enlarging a borehole in a subterranean formation are also provided. Further provided is a method of activating a downhole apparatus within a borehole of a subterranean formation.

27 Claims, 12 Drawing Sheets

(56) References Cited

U.S. PATENT DOCUMENTS

| | | | | | |
|---|---|---|---|---|---|
| 2,758,819 | A | | 8/1956 | Kammerer, Jr. et al. | |
| 2,799,479 | A | * | 7/1957 | Kammerer | 175/268 |
| 2,834,578 | A | | 5/1958 | Carr | |
| 2,882,019 | A | | 4/1959 | Carr et al. | |
| 3,105,562 | A | | 10/1963 | Stone et al. | |
| 3,123,162 | A | | 3/1964 | Rowley | |
| 3,126,065 | A | | 3/1964 | Chadderdon | |
| 3,211,232 | A | | 10/1965 | Grimmer | |
| 3,220,481 | A | * | 11/1965 | Park | 166/193 |
| 3,224,507 | A | | 12/1965 | Cordary et al. | |
| 3,320,004 | A | | 5/1967 | Garrett | |
| 3,332,498 | A | * | 7/1967 | Page, Jr. | 166/321 |
| 3,425,500 | A | | 2/1969 | Fuchs | |
| 3,433,313 | A | | 3/1969 | Brown | |
| 3,528,516 | A | | 9/1970 | Brown | |
| 3,556,233 | A | | 1/1971 | Gilreath | |
| 3,753,471 | A | * | 8/1973 | Kammerer et al. | 175/320 |
| 3,800,891 | A | | 4/1974 | White et al. | |
| 3,845,815 | A | | 11/1974 | Garwood | |
| 3,851,719 | A | | 12/1974 | Thompson et al. | |
| 3,916,998 | A | | 11/1975 | Bass, Jr. et al. | |
| 4,055,226 | A | | 10/1977 | Weber | |
| 4,111,262 | A | | 9/1978 | Duncan | |
| 4,227,586 | A | | 10/1980 | Bassinger | |
| 4,304,311 | A | | 12/1981 | Shinn | |
| 4,403,659 | A | | 9/1983 | Upchurch | |
| 4,440,222 | A | | 4/1984 | Pullin | |
| 4,456,080 | A | | 6/1984 | Holbert | |
| 4,458,761 | A | | 7/1984 | Van Vreeswyk | |
| 4,499,958 | A | | 2/1985 | Radtke et al. | |
| 4,503,919 | A | | 3/1985 | Suied | |
| 4,540,941 | A | | 9/1985 | Walkow | |
| 4,545,441 | A | | 10/1985 | Williamson | |
| 4,565,252 | A | * | 1/1986 | Campbell et al. | 175/269 |
| 4,589,504 | A | | 5/1986 | Simpson | |
| 4,618,009 | A | | 10/1986 | Carter et al. | |
| 4,635,738 | A | | 1/1987 | Schillinger et al. | |
| 4,660,657 | A | | 4/1987 | Furse et al. | |
| 4,665,511 | A | | 5/1987 | Rodney et al. | |
| 4,690,229 | A | | 9/1987 | Raney | |
| 4,693,328 | A | | 9/1987 | Furse et al. | |
| 4,711,326 | A | | 12/1987 | Baugh et al. | |
| 4,715,440 | A | | 12/1987 | Boxell et al. | |
| 4,842,083 | A | | 6/1989 | Raney | |
| 4,848,490 | A | | 7/1989 | Anderson | |
| 4,854,403 | A | | 8/1989 | Ostertag et al. | |
| 4,877,092 | A | | 10/1989 | Helm et al. | |
| 4,884,477 | A | | 12/1989 | Smith et al. | |
| 4,889,197 | A | | 12/1989 | Boe | |
| 5,139,098 | A | | 8/1992 | Blake | |
| 5,175,429 | A | | 12/1992 | Hall, Jr. et al. | |
| 5,211,241 | A | | 5/1993 | Mashaw, Jr. et al. | |
| 5,224,558 | A | | 7/1993 | Lee | |
| 5,265,684 | A | | 11/1993 | Rosenhauch | |
| 5,293,945 | A | | 3/1994 | Rosenhauch et al. | |
| 5,305,833 | A | | 4/1994 | Collins | |
| 5,318,131 | A | | 6/1994 | Baker | |
| 5,318,137 | A | | 6/1994 | Johnson et al. | |
| 5,318,138 | A | | 6/1994 | Dewey et al. | |
| 5,332,048 | A | | 7/1994 | Underwood et al. | |
| 5,343,963 | A | | 9/1994 | Bouldin et al. | |
| 5,361,859 | A | | 11/1994 | Tibbitts | |
| 5,368,114 | A | | 11/1994 | Tandberg et al. | |
| 5,375,662 | A | | 12/1994 | Echols, III et al. | |
| 5,402,856 | A | | 4/1995 | Warren et al. | |
| 5,402,859 | A | | 4/1995 | Boberg et al. | |
| 5,413,180 | A | | 5/1995 | Ross et al. | |
| 5,425,423 | A | | 6/1995 | Dobson et al. | |
| 5,437,308 | A | | 8/1995 | Morin et al. | |
| 5,443,129 | A | | 8/1995 | Bailey et al. | |
| 5,469,736 | A | | 11/1995 | Moake | |
| 5,492,186 | A | | 2/1996 | Overstreet et al. | |
| 5,495,899 | A | | 3/1996 | Pastusek et al. | |
| 5,497,842 | A | | 3/1996 | Pastusek et al. | |
| 5,518,073 | A | | 5/1996 | Manke et al. | |
| 5,553,678 | A | | 9/1996 | Barr et al. | |
| 5,558,162 | A | | 9/1996 | Manke et al. | |
| 5,560,440 | A | | 10/1996 | Tibbitts | |
| 5,582,258 | A | | 12/1996 | Tibbitts et al. | |
| 5,647,437 | A | | 7/1997 | Braddick et al. | |
| 5,651,420 | A | | 7/1997 | Tibbitts et al. | |
| 5,663,512 | A | | 9/1997 | Schader et al. | |
| 5,740,864 | A | | 4/1998 | De Hoedt et al. | |
| 5,746,274 | A | * | 5/1998 | Voll et al. | 166/278 |
| 5,765,653 | A | | 6/1998 | Doster et al. | |
| 5,788,000 | A | | 8/1998 | Maury et al. | |
| 5,823,254 | A | | 10/1998 | Dobson et al. | |
| 5,853,054 | A | | 12/1998 | McGarian et al. | |
| 5,862,870 | A | * | 1/1999 | Hutchinson | 175/269 |
| 5,886,303 | A | | 3/1999 | Rodney | |
| 5,887,655 | A | | 3/1999 | Haugen et al. | |
| 5,957,223 | A | | 9/1999 | Doster et al. | |
| 5,992,518 | A | * | 11/1999 | Whitlock | 166/235 |
| 5,992,549 | A | | 11/1999 | Fuller | |
| 6,039,131 | A | | 3/2000 | Beaton | |
| 6,059,051 | A | | 5/2000 | Jewkes et al. | |
| 6,070,677 | A | | 6/2000 | Johnston, Jr. | |
| RE36,817 | E | | 8/2000 | Pastusek et al. | |
| 6,109,354 | A | | 8/2000 | Ringgenberg et al. | |
| 6,116,336 | A | | 9/2000 | Adkins et al. | |
| 6,131,662 | A | * | 10/2000 | Ross | 166/369 |
| 6,131,675 | A | | 10/2000 | Anderson | |
| 6,138,779 | A | | 10/2000 | Boyce | |
| 6,179,066 | B1 | | 1/2001 | Nasr et al. | |
| 6,189,631 | B1 | | 2/2001 | Sheshtawy | |
| 6,213,226 | B1 | | 4/2001 | Eppink et al. | |
| 6,227,312 | B1 | | 5/2001 | Eppink et al. | |
| 6,234,259 | B1 | | 5/2001 | Kuckes | |
| 6,289,999 | B1 | | 9/2001 | Dewey et al. | |
| 6,325,151 | B1 | | 12/2001 | Vincent et al. | |
| 6,328,117 | B1 | | 12/2001 | Berzas et al. | |
| 6,360,831 | B1 | | 3/2002 | Akesson et al. | |
| 6,378,632 | B1 | | 4/2002 | Dewey et al. | |
| 6,488,104 | B1 | | 12/2002 | Eppink et al. | |
| 6,494,272 | B1 | | 12/2002 | Eppink et al. | |
| 6,499,537 | B1 | | 12/2002 | Dewey et al. | |
| 6,533,050 | B2 | | 3/2003 | Molloy | |
| 6,615,933 | B1 | | 9/2003 | Eddison | |
| 6,651,756 | B1 | | 11/2003 | Costo, Jr. et al. | |
| 6,668,949 | B1 | * | 12/2003 | Rives | 175/269 |
| 6,695,080 | B2 | | 2/2004 | Presley et al. | |
| 6,702,020 | B2 | * | 3/2004 | Zachman et al. | 166/278 |
| 6,708,785 | B1 | | 3/2004 | Russell et al. | |
| 6,732,817 | B2 | | 5/2004 | Dewey et al. | |
| 6,739,416 | B2 | | 5/2004 | Presley et al. | |
| 6,880,650 | B2 | | 4/2005 | Hoffmaster et al. | |
| 6,886,633 | B2 | | 5/2005 | Fanuel et al. | |
| 6,920,930 | B2 | | 7/2005 | Allamon et al. | |
| 6,920,944 | B2 | | 7/2005 | Eppink et al. | |
| 6,991,046 | B2 | | 1/2006 | Fielder et al. | |
| 7,021,389 | B2 | * | 4/2006 | Bishop et al. | 166/373 |
| 7,036,611 | B2 | | 5/2006 | Radford et al. | |
| 7,048,078 | B2 | | 5/2006 | Dewey et al. | |
| 7,069,775 | B2 | | 7/2006 | Fredette et al. | |
| 7,083,010 | B2 | | 8/2006 | Eppink et al. | |
| 7,100,713 | B2 | | 9/2006 | Tulloch | |
| 7,108,067 | B2 | | 9/2006 | Themig et al. | |
| 7,234,542 | B2 | | 6/2007 | Vail, III | |
| 7,251,590 | B2 | | 7/2007 | Huang et al. | |
| 7,252,163 | B2 | | 8/2007 | Ollerenshaw et al. | |
| 7,287,603 | B2 | | 10/2007 | Hay et al. | |
| 7,293,616 | B2 | | 11/2007 | Tulloch | |
| 7,308,937 | B2 | | 12/2007 | Radford et al. | |
| 7,314,099 | B2 | | 1/2008 | Dewey et al. | |
| 7,325,630 | B2 | * | 2/2008 | Takhaundinov et al. | 175/269 |
| 7,395,882 | B2 | | 7/2008 | Oldham et al. | |
| 7,451,836 | B2 | | 11/2008 | Hoffmaster et al. | |
| 7,451,837 | B2 | | 11/2008 | Hoffmaster et al. | |
| 7,464,013 | B2 | | 12/2008 | Huang et al. | |
| 7,493,971 | B2 | | 2/2009 | Nevlud et al. | |
| 7,506,703 | B2 | | 3/2009 | Campbell et al. | |
| 7,513,318 | B2 | | 4/2009 | Underwood et al. | |
| 7,549,485 | B2 | | 6/2009 | Radford et al. | |
| 7,658,241 | B2 | | 2/2010 | Lassoie et al. | |

(56) References Cited

U.S. PATENT DOCUMENTS

| | | | | |
|---|---|---|---|---|
| 7,665,545 | B2 | 2/2010 | Telfer | |
| 7,757,787 | B2 | 7/2010 | Mackay et al. | |
| 7,814,990 | B2 | 10/2010 | Dykstra et al. | |
| 7,832,506 | B2 | 11/2010 | Liang et al. | |
| 7,845,436 | B2 | 12/2010 | Cooley et al. | |
| 7,882,905 | B2 | 2/2011 | Radford et al. | |
| 7,900,717 | B2 | 3/2011 | Radford et al. | |
| 8,028,767 | B2 | 10/2011 | Radford et al. | |
| 8,297,381 | B2 | 10/2012 | Radford et al. | |
| 2001/0017224 | A1 | 8/2001 | Evans et al. | |
| 2002/0070052 | A1 | 6/2002 | Armell et al. | |
| 2003/0029644 | A1 | 2/2003 | Hoffmaster et al. | |
| 2003/0155155 | A1 | 8/2003 | Dewey et al. | |
| 2004/0108109 | A1* | 6/2004 | Allamon et al. | 166/243 |
| 2004/0134687 | A1* | 7/2004 | Radford et al. | 175/57 |
| 2004/0149493 | A1 | 8/2004 | McDonough | |
| 2004/0154836 | A1 | 8/2004 | Hoffmaster et al. | |
| 2005/0145417 | A1* | 7/2005 | Radford et al. | 175/57 |
| 2005/0241856 | A1 | 11/2005 | Lassoie et al. | |
| 2005/0241858 | A1 | 11/2005 | Eppink et al. | |
| 2005/0259512 | A1 | 11/2005 | Mandal | |
| 2005/0274546 | A1* | 12/2005 | Fanuel et al. | 175/57 |
| 2005/0284659 | A1 | 12/2005 | Hall et al. | |
| 2006/0113113 | A1 | 6/2006 | Underwood et al. | |
| 2006/0118339 | A1 | 6/2006 | Takhaundinov et al. | |
| 2006/0124317 | A1 | 6/2006 | Telfer | |
| 2006/0144623 | A1 | 7/2006 | Ollerensaw et al. | |
| 2006/0207801 | A1 | 9/2006 | Clayton | |
| 2006/0249307 | A1 | 11/2006 | Ritter et al. | |
| 2007/0005316 | A1 | 1/2007 | Paez | |
| 2007/0017708 | A1 | 1/2007 | Radford et al. | |
| 2007/0089912 | A1 | 4/2007 | Eddison et al. | |
| 2007/0192071 | A1 | 8/2007 | Huang et al. | |
| 2008/0105464 | A1 | 5/2008 | Radford et al. | |
| 2008/0110678 | A1 | 5/2008 | Radford | |
| 2008/0128174 | A1 | 6/2008 | Radford et al. | |
| 2008/0128175 | A1 | 6/2008 | Radford et al. | |
| 2009/0114448 | A1 | 5/2009 | Laird et al. | |
| 2009/0145666 | A1 | 6/2009 | Radford et al. | |
| 2009/0242275 | A1 | 10/2009 | Radford et al. | |
| 2009/0242277 | A1 | 10/2009 | Radford et al. | |
| 2009/0294178 | A1 | 12/2009 | Radford | |
| 2010/0006282 | A1 | 1/2010 | Dirdal | |
| 2010/0224414 | A1 | 9/2010 | Radford et al. | |
| 2011/0005836 | A1 | 1/2011 | Radford et al. | |
| 2011/0284233 | A1 | 11/2011 | Wu et al. | |

FOREIGN PATENT DOCUMENTS

| | | | |
|---|---|---|---|
| EP | 0594420 | B1 | 4/1994 |
| EP | 1188898 | A2 | 3/2002 |
| EP | 1036913 | A1 | 10/2002 |
| EP | 1044314 | A1 | 3/2005 |
| EP | 1614852 | | 1/2006 |
| GB | 2328964 | A | 3/1999 |
| GB | 2344607 | A | 6/2000 |
| GB | 2344122 | B | 4/2003 |
| GB | 2420803 | A | 6/2006 |
| GB | 2393461 | B | 10/2006 |
| GB | 2426269 | B | 2/2007 |
| RU | 2172385 | | 3/2000 |
| WO | 9421889 | | 9/1994 |
| WO | 0031371 | A1 | 6/2000 |
| WO | 0235048 | | 5/2002 |
| WO | 2004074630 | | 9/2004 |
| WO | 2006083738 | | 8/2006 |
| WO | 2007017651 | | 2/2007 |

OTHER PUBLICATIONS

U.S. Appl. No. 12/416,386, filed Apr. 1, 2009, entitled "Compound Engagement Profile on a Blade of a Down-Hole Stabilizer and Methods Therefor," by Steven R. Radford.

Radford, Steven, et al., "Novel Concentric Expandable Stabilizer Results in Increased Penetration Rates and Drilling Efficiency with Reduced Vibration," SPE/IADC 119534, prepared for presentation at the SPE/IADC Drilling Conference and Exhibition held in Amsterdam, The Netherlands, Mar. 17-19, 2009, 13 pages.

U.S. Appl. No. 12/416,386, filed Apr. 1, 2009, entitled "Compound Engagement Profile on a Blade of a Down-Hole Stabilizer and Methods Therefor," by Radford et al.

International Search Report for PCT/US2007/024796, dated Jul. 11, 2008, 7 pages.

Written Opinion of the International Searching Authority for PCT/US2007/024796, dated Jul. 11, 2008, 10 pages.

U.S. Appl. No. 12/058,384, filed Mar. 28, 2008, entitled "Stabilizer and Reamer System Having Extensible Blades and Bearing Pads and Method of Using Same," by Radford et al.

U.S. Appl. No. 12/501,688, filed Jul. 13, 2009, entitled "Stabilizer Ribs on Lower Side of Expandable Reamer Apparatus to Reduce Operating Vibration," by Redford et al.

International Search Report for International Application No. PCT/US2009/038194, mailed Nov. 9, 2009.

US 5,344,598, 3/1944, Church (withdrawn).

Merriam-Webster Dictionary, Defintions of "Retain" and "Keep" accessed May 20, 2010 from www.merriam-webster.com.

PCT International Search Report for International Application No. PCT/US2009/042511, mailed Dec. 1, 2009.

International Search Report for International Application No. PCT/US2010/025867 mailed Oct. 15, 2010, 3 pages.

International Written Opinion for International Application No. PCT/US2010/025867 mailed Oct. 15, 2010, 6 pages.

International Search Report for International Application No. PCT/US2010/041676 mailed Feb. 22, 2011, 4 pages.

International Written Opinion for International Application No. PCT/US2010/041676 mailed Feb. 22, 2011, 3 pages.

International Written Opinion for International Application No. PCT/US2009/038194 mailed Nov. 9, 2009, 4 pages.

International Written Opinion for International Application No. PCT/US2007/024795 mailed Mar. 28, 2008, 6 pages.

PCT International Search Report and Written Opinion of the International Searching Authority for PCT/US2009/039097, dated Oct. 28, 2009, 8 pages.

Schlumberger Oilfield Glossary entry for "Caliper Log" as it appeared Sep. 3, 2005. Accessed via www.archive.org.

* cited by examiner

RESTRICTION ELEMENT TRAP FOR USE WITH AN ACTUATION ELEMENT OF A DOWNHOLE APPARATUS AND METHOD OF USE

CROSS-REFERENCE TO RELATED APPLICATION

The present application is also related to U.S. patent application Ser. No. 11/949,259, filed Dec. 3, 2007, entitled Expandable Reamers for Earth Boring Applications, now U.S. Pat. No. 7,900,717, issued Mar. 8, 2011, which is a non-provisional of U.S. Provisional Patent Application Serial No. 60/872,744, filed Dec. 4, 2006; U.S. patent application Ser. No. 12/058,384, filed Mar. 28, 2008, entitled Stabilizer and Reamer System Having Extensible Blades and Bearing Pads and Method of Using Same, now U.S. Pat. No. 7,882,905, issued Feb. 8, 2011; U.S. patent application Ser. No. 12/501,688, filed Jul. 13, 2009, entitled Stabilizer Ribs on Lower Side of Expandable Reamer Apparatus to Reduce Operating Vibration, now U.S. Pat. No. 8,297,381, issued Oct. 30, 2012; U.S. patent application Ser. No. 12/433,939, filed May 1, 2009, entitled Stabilizer and Reamer System Having Extensible Blades and Bearing Pads and Method of Using Same, now U.S. Pat. No. 8,205,689, issued Jun. 26, 2012, which is a non-provisional of U.S. Provisional Patent application Serial No. 61/049,617, filed May 1, 2008; and U.S. patent application Ser. No. 12/715,610, filed Mar. 2, 2010, entitled Chip Deflector on a Blade of a Downhole Reamer and Methods Therefore, now abandoned, which is a non-provisional of U.S. Provisional Patent Application Serial No. 61/156,936, filed Mar. 3, 2009; and U.S. patent application Ser. No. 13/662,862, filed Oct. 29, 2012, pending, each of which is assigned to the Assignee of the present application.

FIELD OF THE INVENTION

The present invention relates generally to a restriction element trap for use with an actuation element of a downhole apparatus and method of use thereof and, more particularly, to a trap sleeve in an actuation sleeve for conditionally exposing hydraulic fluid pressure to operational components of an expandable reamer apparatus for enlarging a subterranean borehole beneath a casing or liner.

BACKGROUND

Expandable reamers are typically employed for enlarging subterranean boreholes. Conventionally in drilling oil, gas, and geothermal wells, casing is installed and cemented to prevent the well bore walls from caving into the subterranean borehole while providing requisite shoring for subsequent drilling operations to achieve greater depths. Casing is also conventionally installed to isolate different formations, to prevent cross-flow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach, as generally described in U.S. Pat. No. 7,036,611 entitled "Expandable Reamer Apparatus for Enlarging Boreholes While Drilling and Methods of Use," the entire disclosure of which is incorporated by reference herein, provides for displacing an actuation sleeve allowing hydraulic fluid pressure to be directed at actuating laterally movable blades for reaming a borehole. The actuation sleeve is releasably restrained within an inner bore of an expandable reamer apparatus by way of shear pins, interlocking members, frictional elements, or friable members, and includes a fluid flow path through a sleeve seat. The fluid flow path is interrupted when a restriction element, such as a so-called "drop ball," is deployed upon the sleeve seat allowing hydraulic fluid pressure to build thereupon until the actuation sleeve is displaced. The restriction element is retained within the sleeve seat by gravity or while fluid pressure is maintained thereupon. However, conventional reamer designs do not provide positive retention of the restriction element.

A conventional gravel packing tool as generally described in U.S. Pat. No. 6,702,020 entitled "Crossover Tool," the entire disclosure of which is incorporated by reference herein, provides a sleeve for trapping a ball. The ball is dropped into the tool and lands on a thin sleeve, which acts as the initial ball seat. Upon pressure buildup, the ball is forced past the thin sleeve and into sealing contact with a seat of a second sleeve, which is an extension of the thin sleeve and where both sleeves are retained in the tool. A shear pin holds the second sleeve in its initial position. A snap ring is mounted to the second sleeve and it is able to snap out of its recess allowing the second sleeve shifts as a result of applied fluid pressure upon the ball on the seat and when the fluid pressure is sufficient to shear the shear pins holding the second sleeve in its initial position. As a result of this movement, the internal diameter of the thin sleeve, through which the ball has already been forced, is further reduced as it is pulled through a reduced diameter of a surrounding body and locks the ball into the seat. The ball cannot be dislodged, particularly in the opposite direction, until a predetermined pressure is exceeded. Undesirably, dynamic motion required by the thin sleeve and the second sleeve in order to secure the ball only occurs after sufficient fluid pressure has been applied for shearing the shear pins and releasing the snap ring. Also, a sleeve for trapping a ball of a conventional gravel packing tool is undesirable for use with a downhole tool that includes an actuation sleeve, such as an expandable reamer apparatus, particularly where the actuation sleeve is selectively retained by fluid pressure and release of the actuation sleeve is desired only after the restriction elements is secured.

Furthermore, the shockwave or pressure build-up in order to secure the restriction element may likely initiate premature releasing of an actuation sleeve, rendering the captioning of the restriction element in an indeterminate or unknown state and possible premature tool activation.

Accordingly, it would be desirable to improve the performance of a downhole apparatus, such as an expandable reamer apparatus, by providing positive and robust retention of a restriction element. There is a further desire to provide determinate retention of a restriction element within an actuation element, such as the traveling sleeve of an expandable reamer apparatus. Moreover, there is a desire to provide verifiable retention of a restriction element prior to dynamic release of an actuation element. Lastly, there is a desire to provide positive retention of a restriction element without necessitating dynamically moving parts.

BRIEF SUMMARY OF THE INVENTION

In order to provide positive and robust retention of a restriction element, a downhole apparatus is provided in at least one embodiment of the invention for engaging a borehole wall in a subterranean formation. The downhole apparatus includes a tubular body having a longitudinal axis and a first bore, an actuation element having a second bore and is positioned within the first bore of the tubular body, a drilling fluid flow path extending through the first and second bores, and a restriction element trap positioned within the second bore of the actuation element. The actuation element is configured to selectively retain an operable component of the downhole apparatus in an initial position and the restriction element trap is configured for retentively receiving a restriction element.

In other embodiments of the invention, a restriction element trap for use with an actuation element for retentively receiving a restriction element is provided. The restriction element trap provides determinate retention of a restriction element when used with, for example, a traveling sleeve of an expandable reamer apparatus.

In still other embodiments of the invention, an expandable reamer apparatus for enlarging a borehole in a subterranean formation is also provided. The expandable reamer apparatus is configured for positive retention of a restriction element with passive components.

Further, a method of using a downhole apparatus within a borehole of a subterranean formation is provided. The method provides verifiable retention of a restriction element within the downhole apparatus prior to dynamic release of an actuation element.

BRIEF DESCRIPTION OF THE DRAWINGS

While the specification concludes with claims particularly pointing out and distinctly claiming that which is regarded as the invention various features and advantages of this invention may be more readily ascertained from the following description of the invention when read in conjunction with the accompanying drawings, in which:

DETAILED DESCRIPTION OF THE INVENTION

The illustrations presented herein are, in some instances, not actual views of any particular downhole apparatus, restriction element trap in an actuation element, or other feature of a downhole apparatus, such as an expandable reamer apparatus, but are merely idealized representations that are employed to describe the present invention. Additionally, elements common between figures may retain the same numerical designation.

Figure 1:
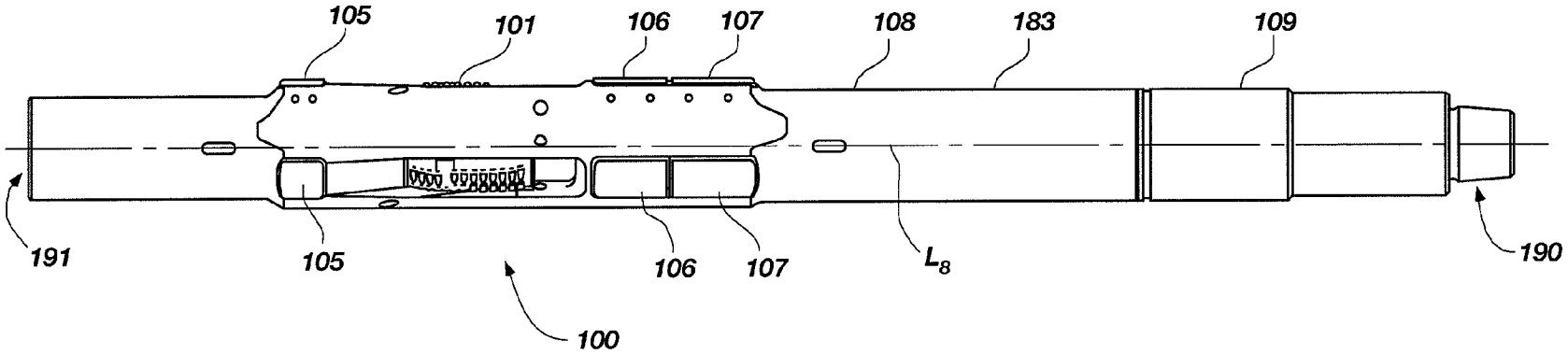
FIG. 1 is a side view of an expandable reamer apparatus comprising a restriction element trap in accordance with an embodiment of the invention.

An expandable reamer apparatus 100 comprising a restriction element trap (reference numeral 200 shown in FIG. 2) according to an embodiment of the invention is shown in FIG. 1. The expandable reamer apparatus 100 may include a generally cylindrical tubular body 108 having a longitudinal axis $L_8$. The tubular body 108 of the expandable reamer apparatus 100 may have a lower end 190 and an upper end 191. The terms "lower" and "upper," as used herein with reference to the ends 190, 191, refer to the typical positions of the ends 190, 191 relative to one another when the expandable reamer apparatus 100 is positioned within a well bore. The lower end 190 of the tubular body 108 of the expandable reamer apparatus 100 may include a set of threads (e.g., a threaded male pin member) for connecting the lower end 190 to another section of a drill string or another component of a bottom-hole assembly (BHA), such as, for example, a drill collar or collars carrying a pilot drill bit for drilling a well bore. Similarly, the upper end 191 of the tubular body 108 of the expandable reamer apparatus 100 may include a set of threads (e.g., a threaded female box member) for connecting the upper end 191 to another section of a drill string or another component of a bottom-hole assembly (BHA).

Figure 7:
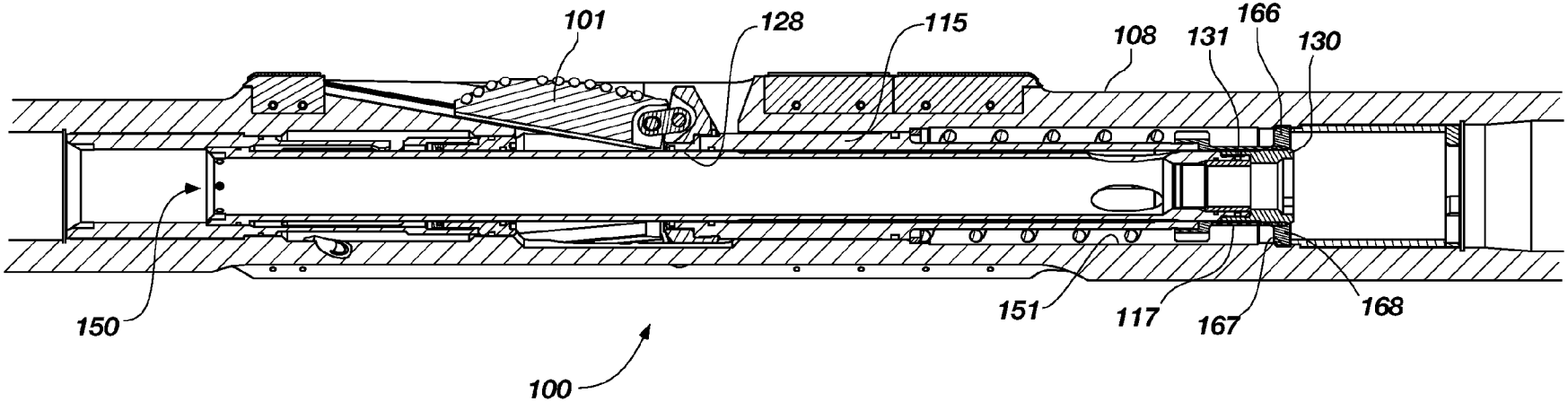
FIG. 7 shows a partial, longitudinal cross-sectional illustration of an embodiment of the expandable reamer apparatus in a closed, or retracted, initial tool position.

Three sliding cutter blocks or blades 101 are positionally retained in circumferentially spaced relationship in the tubular body 108 as further described below and may be provided at a position along the expandable reamer apparatus 100 intermediate the first lower end 190 and the second upper end 191. The blades 101 may be comprised of steel, tungsten carbide, a particle-matrix composite material (e.g., hard particles dispersed throughout a metal matrix material), or other suitable materials as known in the art. The blades 101 are retained in an initial, retracted position within the tubular body 108 of the expandable reamer apparatus 100 as illustrated in FIG. 7, but may be moved responsive to application of hydraulic pressure into the extended position (shown in FIG. 12) and moved into a retracted position (shown in FIG. 13) when desired, as will be described herein. The expandable reamer apparatus 100 may be configured such that the blades 101 engage the walls of a subterranean formation surrounding a well bore in which apparatus 100 is disposed to remove formation material when the blades 101 are in the extended position, but are not operable to so engage the walls of a subterranean formation within a well bore when the blades 101 are in the retracted position. While the expandable reamer apparatus 100 includes three blades 101, it is contemplated that one, two or more than three blades may be utilized to advantage. Moreover, while the blades 101 are symmetrically circumferentially positioned axial along the tubular body 108, the blades 101 may also be positioned circumferentially asymmetrically as well as asymmetrically along the longitudinal axis $L_8$ in the direction of either end 190 and 191.

Figure 2:
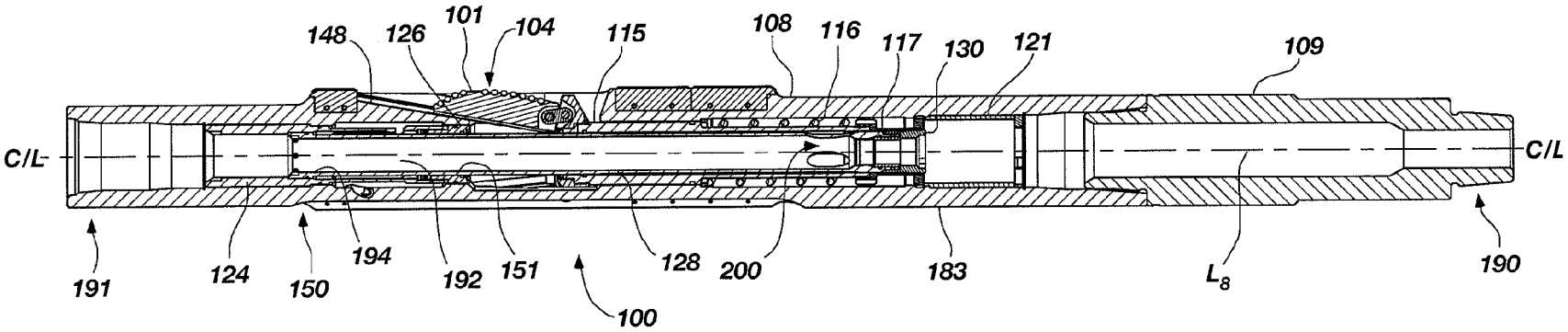
FIG. 2 shows a longitudinal cross-sectional view of the expandable reamer apparatus shown in FIG. 1.

As shown in FIG. 2, the tubular body 108 encloses a fluid passageway 192 that extends longitudinally through the tubular body 108. The fluid passageway 192 directs fluid substantially through an inner bore 151 of an actuation element, or traveling sleeve 128 in bypassing relationship to substantially shield the blades 101 from exposure to drilling fluid flow, particularly in the lateral direction, or normal to the longitudinal axis $L_8$. Advantageously, due to this arrangement, the particulate-entrained fluid is less likely to cause build-up or interfere with the operational aspects of the expandable reamer apparatus 100 by shielding the blades 101 from exposure with the fluid. However, it is recognized that beneficial shielding of the blades 101 is not necessary to the operation of the expandable reamer apparatus 100 where, as explained in further detail below, the operation, i.e., extension from the initial position, the extended position and the retracted position, occurs by an axially directed force that is the net effect of the fluid pressure and spring biasing forces. In this embodiment, the axially directed force directly actuates the blades 101 by axially influencing the actuating means, such as a push sleeve 116, for example, and without limitation, as better described herein below.

Figure 12:
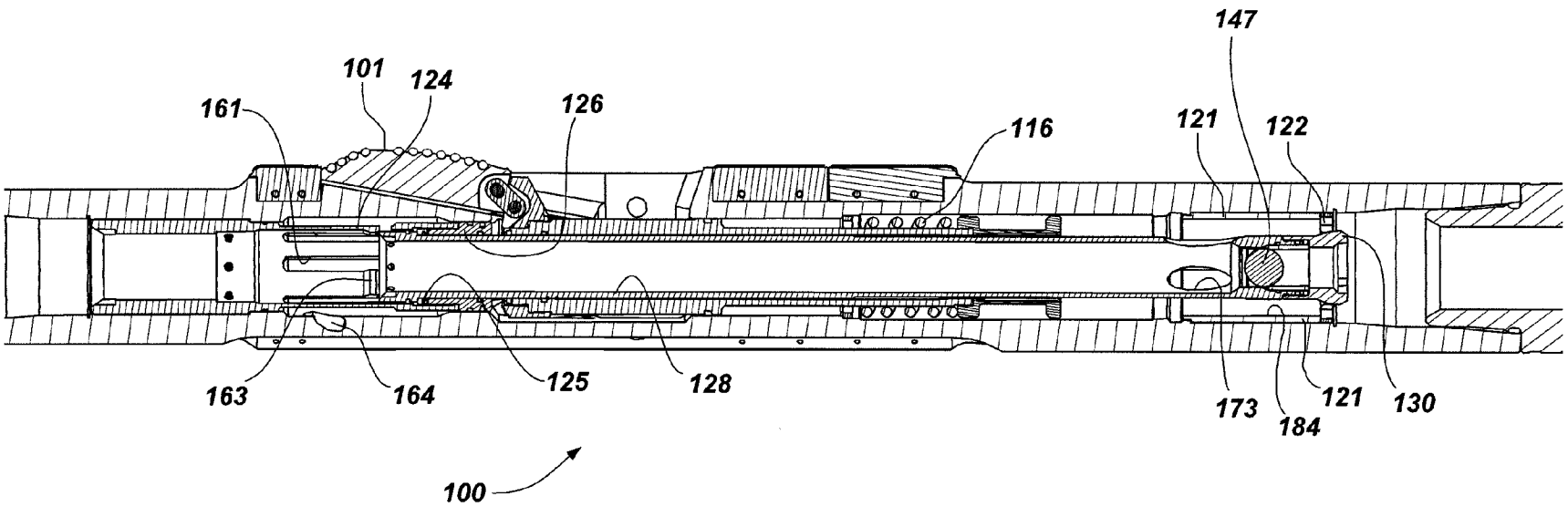
FIG. 12 shows a partial, longitudinal cross-sectional illustration of the expandable reamer apparatus of FIG. 7 in which the blades (one depicted) are held in the fully extended position by the push sleeve under the influence of fluid pressure and the traveling sleeve moves into the retained position.

The expandable reamer apparatus 100 may be configured such that the outermost radial or lateral extent of each of the blades 101 is recessed within the tubular body 108 when in the initial or retracted positions so it may not extend beyond the greatest extent of outer diameter of the tubular body 108. Such an arrangement may protect the blades 101 as the expandable reamer apparatus 100 is disposed within a casing of a borehole, and may allow the expandable reamer apparatus 100 to pass through such casing within a borehole. In other embodiments, the outermost radial extent of the blades 101 may coincide with or slightly extend beyond the outer diameter of the tubular body 108. As illustrated in FIG. 12, the blades 101 may extend beyond the outer diameter of the tubular body 108 when in the extended position, to engage the walls of a borehole in a reaming operation.

Figure 3:
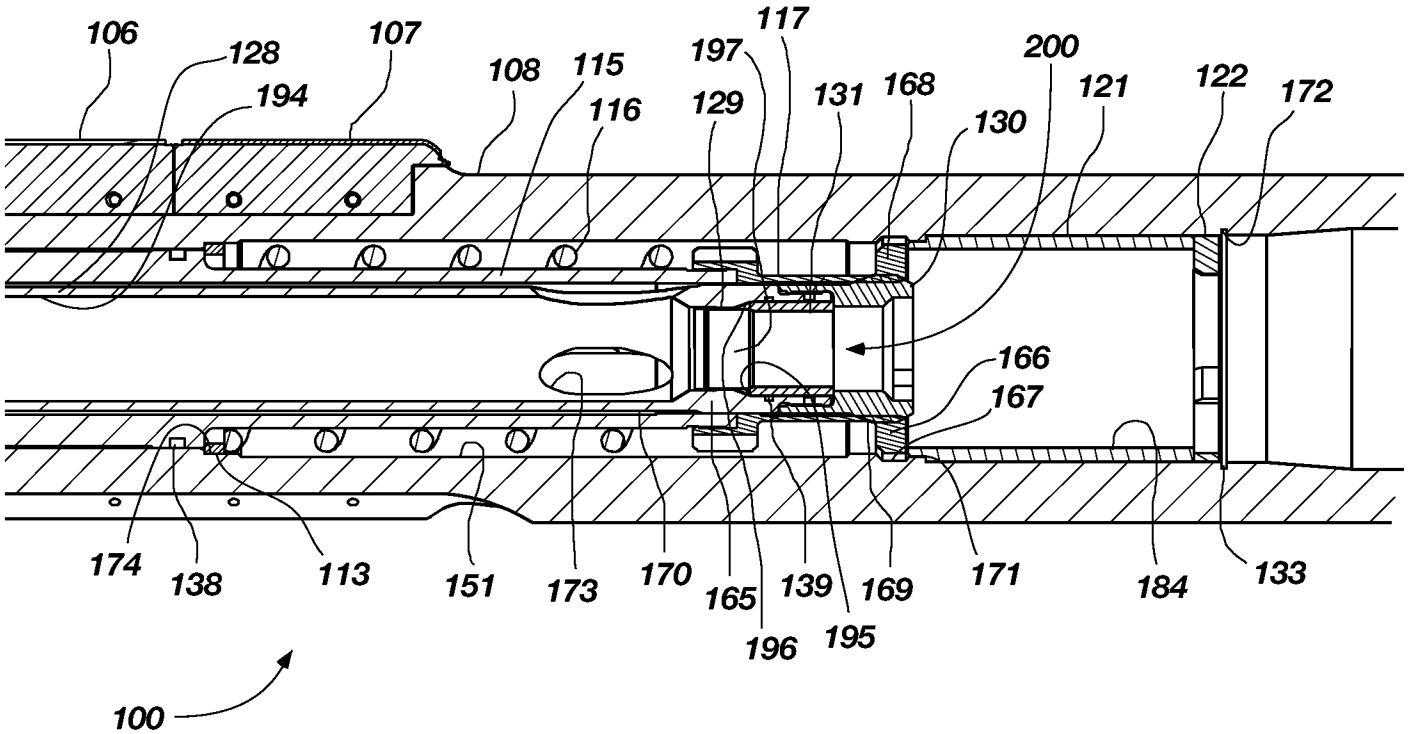
FIG. 3 shows an enlarged cross-sectional view of another portion of the expandable reamer apparatus shown in FIG. 2.
Figure 4:
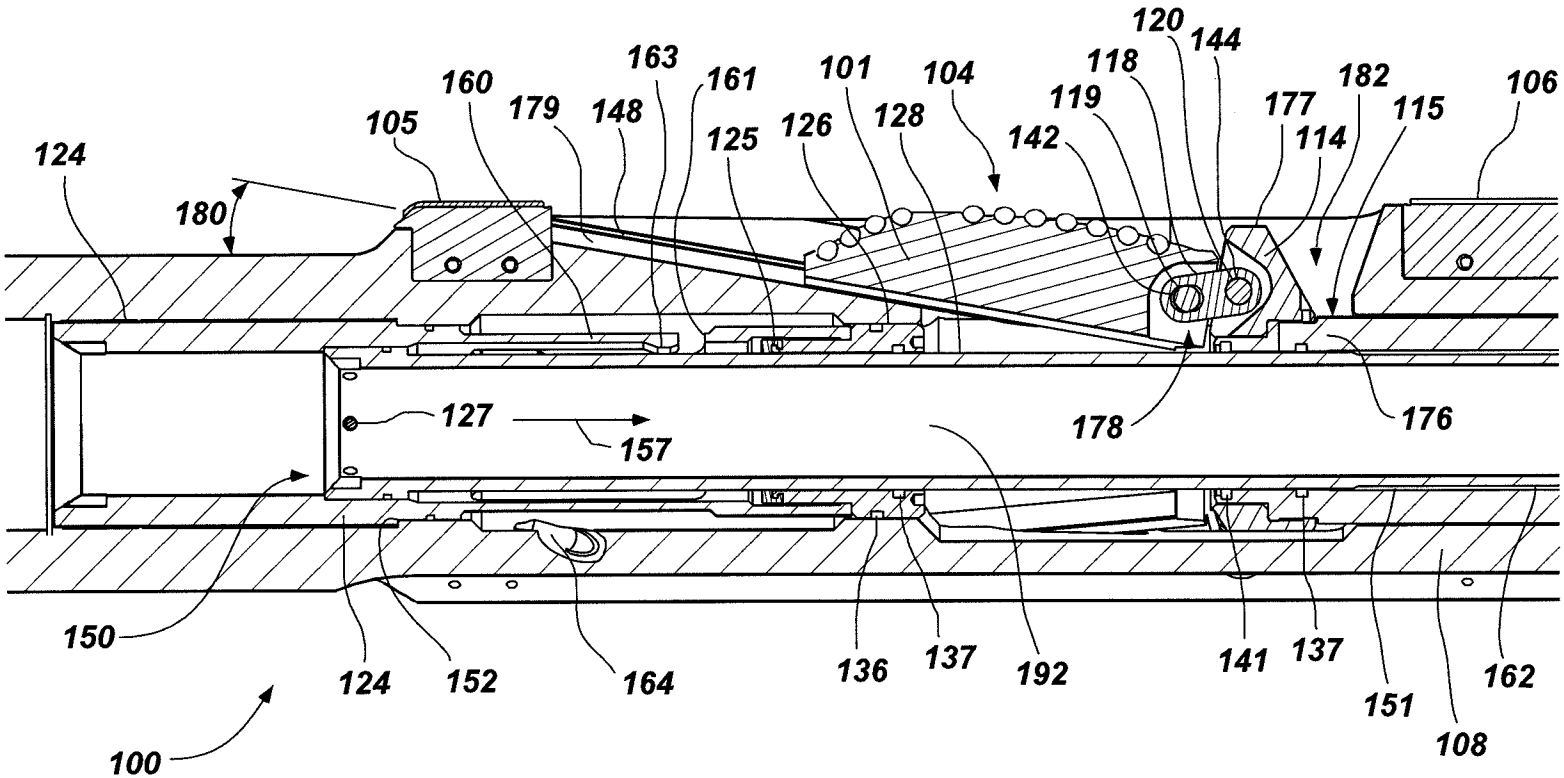
FIG. 4 shows an enlarged cross-sectional view of yet another portion of the expandable reamer apparatus shown in FIG. 2.
Figure 5:
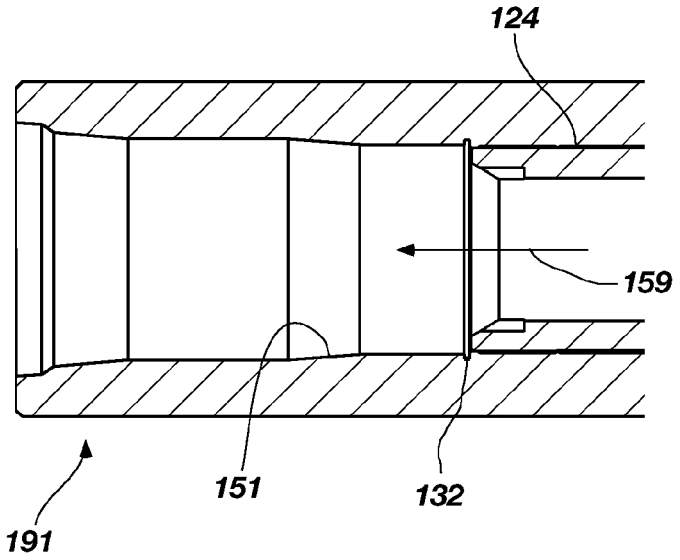
FIG. 5 shows an enlarged cross-sectional view of a further portion of the expandable reamer apparatus shown in FIG. 2.

With continued reference to FIG. 2, reference may also be made to FIGS. 3-5, which show enlarged partial longitudinal cross-sectional views of various portions of the expandable reamer apparatus 100. Reference may also be made back to FIG. 1 as desired. The tubular body 108 positionally respectively retains three sliding cutter blocks or blades 101 in three blade tracks 148. The blades 101 each carry a plurality of cutting elements 104 for engaging the material of a subterranean formation defining the wall of an open borehole when the blades 101 are in an extended position (shown in FIG. 12). The cutting elements 104 may be polycrystalline diamond compact (PDC) cutters or other cutting elements known to a person of ordinary skill in the art.

Figure 6:
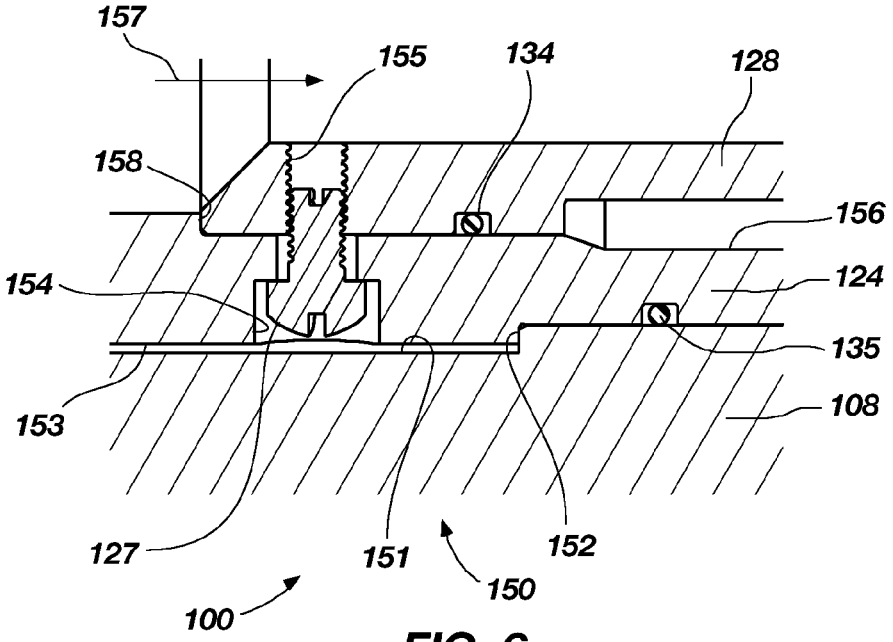
FIG. 6 shows a cross-sectional view of a shear assembly of an embodiment of the expandable reamer apparatus.

The expandable reamer apparatus 100 includes a shear assembly 150 for retaining the expandable reamer apparatus 100 in the initial position by securing the traveling sleeve 128 toward the upper end 191 thereof. Reference may also be made to FIG. 6, showing a partial view of the shear assembly 150. The shear assembly 150 includes an uplock sleeve 124, some number of shear screws 127 and the traveling sleeve 128. The uplock sleeve 124 is retained within an inner bore 151 of the tubular body 108 between a lip 152 and a retaining ring 132 (shown in FIG. 5), and includes an O-ring seal 135 to prevent fluid from flowing between the outer bore 153 of the uplock sleeve 124 and the inner bore 151 of the tubular body 108. The uplock sleeve 124 includes shear slots 154 for retaining each of the shear screws 127, where, in the current embodiment of the invention, each shear screw 127 is threaded into a shear port 155 of the traveling sleeve 128. The shear screws 127 hold the traveling sleeve 128 within the inner bore 156 of the uplock sleeve 124 to conditionally prevent the traveling sleeve 128 from axially moving in a downhole direction 157, i.e., toward the lower end 190 of the expandable reamer apparatus 100. The uplock sleeve 124 includes an inner lip 158 to prevent the traveling sleeve 128 from moving in the uphole direction 159, i.e., toward the upper end 191 of the expandable reamer apparatus 100. An O-ring seal 134 seals the traveling sleeve 128 between the inner bore 156 of the uplock sleeve 124. When the shear screws 127 are sheared, the traveling sleeve 128 is allowed to axially travel within the tubular body 108 in the downhole direction 157. Advantageously, the portions of the shear screws 127 when sheared are retained within the uplock sleeve 124 and the traveling sleeve 128 in order to prevent the portions from becoming loose or being lodged in other components when drilling the borehole. While shear screws 127 are shown, other shear elements may be used to advantage, for example, without limitation, a shear rod, a shear wire and a shear pin. Optionally, other shear elements may include structure for positive retention within constituent components after being exhausted, similar in manner to the shear screws 127 of the current embodiment of the invention. In this regard, the shear assembly 150 may releasable restrain the actuation sleeve within the inner bore 156 of an expandable reamer apparatus 100 by way of shear pins, interlocking members, frictional elements, or friable and frangible members.

With reference to FIG. 4, uplock sleeve 124 further includes a collet 160 that axially retains a seal sleeve 126 between the inner bore 151 of the tubular body 108 and an outer bore 162 of the traveling sleeve 128. The uplock sleeve 124 also includes one or more ears 163 and one or more ports 161 axially spaced there around. When the traveling sleeve 128 positions a sufficient axial distance in the downhole direction 157, the one or more ears 163 spring radially inward to lock the motion of the traveling sleeve 128 between the ears 163 of the uplock sleeve 124 and between a shock absorbing member 125 mounted upon an upper end of the seal sleeve 126. Also, as the traveling sleeve 128 positions a sufficient axial distance in the downhole direction 157, the one or more ports 161 of the uplock sleeve 124 are fluidly exposed, allowing fluid to communicate with a nozzle intake port 164 from the fluid passageway 192. The shock absorbing member 125 of the seal sleeve 126 provides spring retention of the traveling sleeve 128 with the ears 163 of the uplock sleeve 124 and also mitigates impact shock caused by the traveling sleeve 128 when its motion is stopped by the seal sleeve 126.

Shock absorbing member 125 may comprise a flexible or compliant material, such as, for instance, an elastomer or other polymer. In one embodiment, shock absorbing member 125 may comprise a nitrile rubber. Utilizing a shock absorbing member 125 between the traveling sleeve 128 and seal sleeve 126 may reduce or prevent deformation of at least one of the traveling sleeve 128 and seal sleeve 126 that may otherwise occur due to impact therebetween.

It should be noted that any sealing elements or shock absorbing members disclosed herein that are included within expandable reamer apparatus 100 may comprise any suitable material as known in the art, such as, for instance, a polymer or elastomer. Optionally, a material comprising a sealing element may be selected for relatively high temperature (e.g., about 400° Fahrenheit or greater) use. For instance, seals may be comprised of TEFLON®, polyetheretherketone ("PEEK™") material, a polymer material, or an elastomer, or may comprise a metal-to-metal seal suitable for expected borehole conditions. Specifically, any sealing element or shock absorbing member disclosed herein, such as shock absorbing member 125 and sealing elements 134 and 135, discussed hereinabove, or sealing elements, such as seal 136 discussed herein below, or other sealing elements included by an expandable reamer apparatus of the invention may comprise a material configured for relatively high temperature use, as well as for use in highly corrosive borehole environments.

The seal sleeve 126 includes an O-ring seal 136 sealing it between the inner bore 151 of the tubular body 108, and a T-seal seal 137 sealing it between the outer bore 162 of the traveling sleeve 128, which completes fluid sealing between the traveling sleeve 128 and the nozzle intake port 164. Furthermore, the seal sleeve 126 axially aligns, guides and supports the traveling sleeve 128 within the tubular body 108. Moreover, the seal sleeve 126 seals 136 and 137 may also prevent drilling fluid from leaking from within the expandable reamer apparatus 100 to outside the expandable reamer apparatus 100 by way of the nozzle intake port 164 prior to the traveling sleeve 128 being released from its initial position.

A downhole end 165 of the traveling sleeve 128 (also see FIG. 3), which includes a seat stop sleeve 130, is aligned, axially guided and supported by an annular piston or lowlock sleeve 117. The lowlock sleeve 117 is axially coupled to a push sleeve 115 that is cylindrically retained between the traveling sleeve 128 and the inner bore 151 of the tubular body 108. When the traveling sleeve 128 is in the "ready" or initial position during drilling, the hydraulic pressure may act on the push sleeve 115 and upon the lowlock sleeve 117 between the outer bore 162 of the traveling sleeve 128 and the inner bore 151 of the tubular body 108. With or without hydraulic pressure when the expandable reamer apparatus 100 is in the initial position, the push sleeve 115 is prevented from moving in the uphole direction 159 by a lowlock assembly, i.e., one or more dogs 166 of the lowlock sleeve 117.

The dogs 166 are positionally retained between an annular groove 167 in the inner bore 151 of the tubular body 108 and the seat stop sleeve 130. Each dog 166 of the lowlock sleeve 117 is a collet or locking dog latch having an expandable detent 168 that may engage the groove 167 of the tubular body 108 when compressively engaged by the seat stop sleeve 130. The dogs 166 hold the lowlock sleeve 117 in place and prevent the push sleeve 115 from moving in the uphole direction 159 until the "end" or seat stop sleeve 130, with its larger outer diameter 169, travels beyond the lowlock sleeve 117 allowing the dogs 166 to retract axially inward toward the smaller outer diameter 170 of the traveling sleeve 128. When the dogs 166 retract axially inward they may be disengaged from the groove 167 of the tubular body 108, allowing the push sleeve 115 to move responsive to hydraulic pressure primarily in the axial direction, i.e., in the uphole direction 159.

Advantageously, the lowlock sleeve 117 supports the weight of the traveling sleeve 128, minimizing the extent to which the shear assembly 150 is subjected to forces that potentially could weaken or cause premature failure of the shear elements, i.e., the shear screws 127. Thus, the shear assembly 150 requires an affirmative act, such as introducing a ball or other restriction element into the expandable reamer apparatus 100 to cause the pressure from hydraulic fluid flow to increase as a restriction element is captured in the restriction element trap 200 of the invention, before the shear screws 127 will shear or the shear assembly 150 will release the actuating, or traveling sleeve 128.

The restriction element trap 200 shown in FIGS. 2 and 3 is located in the downhole end 165 of the traveling sleeve 128. It is recognized that the restriction element trap 200 may be located in the mid or upper portion of the actuation element, or traveling sleeve 128. The restriction element trap 200 includes within an inner bore 194 of the traveling sleeve 128 a ball trap sleeve 129 and a tubular plug 131. An O-ring seal 139 may optionally be included to provide an additional seal between the inner bore 194 of the traveling sleeve 128 and the plug 131. A restriction element in the form of a ball 147 (shown in FIGS. 8-13), or other suitable structure, may be introduced into the expandable reamer apparatus 100 in order to enable operation of the expandable reamer apparatus 100 to initiate or "trigger" the action of the shear assembly 150 upon or alter the restriction element is determinatively secured within the restriction element trap 200. After the ball 147 is introduced, fluid will carry the ball 147 into the restriction element trap 200 allowing the ball 147 to be retained by an annular portion 197 of the ball trap sleeve 129 yielding within an enlarged bore 196 of the inner bore 194 of the traveling sleeve 128 and sealed there against the seat portion 195 of the plug 131. Optionally, the ball 147 may be retained within the inner bore of the plug 131 after being lodged therein by hydraulic fluid pressure created by the fluid flow. When the ball 147 occludes fluid flow by being trapped in the ball trap sleeve 129, the fluid or hydraulic pressure will build tip within the expandable reamer apparatus 100 until the shear screws 127 shear. After the shear screws 127 shear, the traveling sleeve 128 along with the coaxially retained seat stop sleeve 130 will axially travel, under the influence of the hydraulic pressure, in the downhole direction 157 until the traveling sleeve 128 is again axially retained by the uplock sleeve 124 as described above or moves into a lower position. Thereafter, the fluid flow may be re-established through the fluid ports 173 in the traveling sleeve 128 above the ball 147. Advantageously, the restriction element trap 200 provides simplified static parts, i.e., the ball trap sleeve 129 and the plug 131, for robustly receiving and retaining a restriction element.

It is to be recognized that the restriction element, i.e., the ball 147, is sized and configured to engage the restriction element trap 200 at seat portion 195 complementarily sized and configured to substantially prevent the flow of drilling fluid through the traveling sleeve 128 and to cause displacement of the traveling sleeve 128 within the expandable reamer apparatus 100 to a position that allows communication between drilling fluid within the inner bore 151 and operational components, such as the actuating structure of the push sleeve 115.

Optionally, the ball 147 used to activate the expandable reamer apparatus 100 may engage the ball trap sleeve 129 and or the plug 131 of the restriction element trap 200 that include malleable characteristics, such that the ball 147 may swage therein as it seats in order to prevent the ball 147 from moving around and potentially causing problems or damage to the expandable reamer apparatus 100. In this regard, the ball trap sleeve 129 and the plug 131 may be made from a resilient malleable material, such as metal, elastomer, or other material having a deformable quality suitable for retentively receiving the ball 147 therein. In this embodiment, the annular portion 197 of the ball trap sleeve 129 is a thin-walled annular conduit made of relatively low yield-strength metal suitable for deforming into the recess of the enlarged bore 196 of the traveling sleeve 128 as the ball 147 is received therein. Optionally, the plug 131 is made of, or lined with, a resilient plastic material, such as tetrafluoroethylene (TFE), being suitable for capturing and stopping the ball 147 as it is trapped therein.

Also, in order to support the traveling sleeve 128 and mitigate vibration effects after the traveling sleeve 128 is axially retained, the seat stop sleeve 130 and the downhole end 165 of the traveling sleeve 128 are retained in a stabilizer sleeve 122. Reference may also be made to FIGS. 3 and 12. The stabilizer sleeve 122 is coupled to the inner bore 151 of the tubular body 108 and retained between a retaining ring 133 and a protect sleeve 121, which is held by an annular lip 171 in the inner bore 151 of the tubular body 108. The retaining ring 133 is held within an annular groove 172 in the inner bore 151 of the tubular body 108. The protect sleeve 121 provides protection from the erosive nature of the hydraulic fluid to the tubular body 108 by allowing hydraulic fluid to flow through fluid ports 173 of the traveling sleeve 128, impinge upon the protect sleeve 121 and past the stabilizer sleeve 122 when the traveling sleeve 128 is retained therein.

Figure 11:
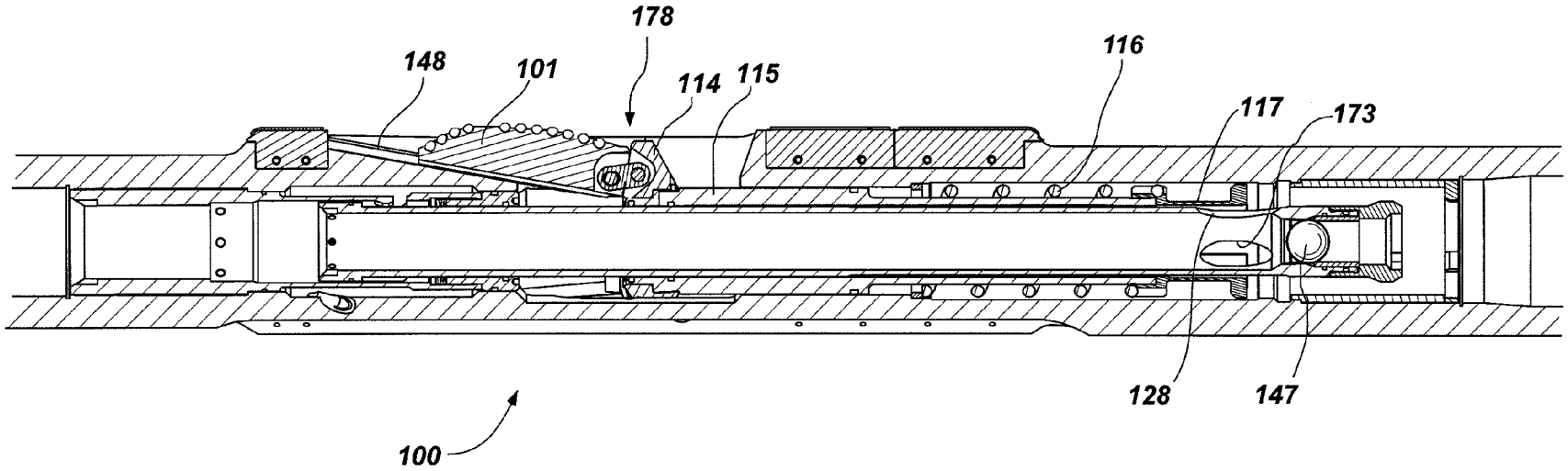
FIG. 11 shows a partial, longitudinal cross-sectional illustration of the expandable reamer apparatus of FIG. 7 in which the traveling sleeve moves toward a lower, retained position while a blade being urged by a push sleeve under the influence of fluid pressure moves toward an extended position.

After the traveling sleeve 128 travels sufficiently far enough to allow the duos 166 of the lowlock sleeve 117 to be disengaged from the groove 167 of the tubular body 108, the dogs 166 of the lowlock sleeve 117 being connected to the push sleeve 115 may all move in the uphole direction 159. Reference may also be made to FIGS. 3, 4 and 11. In order for the push sleeve 115 to move in the uphole direction 159, the differential pressure between the inner bore 151 and the outer side 183 of the tubular body 108 caused by the hydraulic fluid flow must be sufficient to overcome the restoring force or bias of a spring 116. The compression spring 116 that resists the motion of the push sleeve 115 in the uphole direction 159, is retained on the outer surface of the push sleeve 115 between a ring 113 attached in a groove 174 of the tubular body 108 and the lowlock sleeve 117. The push sleeve 115 may axially travel in the uphole direction 159 under the influence of the hydraulic fluid, but is restrained from moving beyond the top lip of the ring 113 and beyond the protect sleeve 121 in the downhole direction 157. The push sleeve 115 may include a T-seal seal 138 between the tubular body 108, a T-seal seal 137 between the traveling sleeve 128, and a wiper seal 141 between the traveling sleeve 128 and push sleeve 115.

The push sleeve 115 includes at its uphole section 176 a yoke 114 coupled thereto as shown in FIG. 4. The yoke 114 includes three arms 177, each arm 177 being coupled to one of the blades 101 by a pinned linkage 178. The arms 177 may include a shaped surface suitable for expelling debris as the blades 101 are retracted toward the retracted position. The shaped surface of the arms 177, in conjunction with the adjacent wall of the cavity of the body 108, may provide included angles of approximately 20 degrees, which is preferable to dislodge and remove any packed-in shale, and may further include low friction surface material to prevent sticking by formation cuttings and other debris. The pinned linkage 178 includes a linkage 118 coupling a blade 101 to the arm 177, where the linkage 118 is coupled to the blade 101 by a blade pin 119 and secured by a retaining ring 142, and the linkage 118 is coupled to the arm 177 by a yoke pin 120, which is secured by a cotter pin 144. The pinned linkage 178 allows the blades 101 to rotationally transition about the arms 177 of the yoke 114, particularly as the actuating means directly transitions the blades 101 between the extended and retracted positions. Advantageously, the actuating means, i.e., the push sleeve 115, the yoke 114, and or the linkage 178, directly retracts as well as extends the blades 101, whereas conventional wisdom has directed the use of one part for harnessing hydraulic pressure to force the blades 101 laterally outward and another part, such as a spring, to force the blades 101 inward.

In order that the blades 101 may transition between the extended and retracted positions, they are each positionally coupled to one of the blade tracks 148 in the tubular body 108 as particularly shown in FIGS. 2 and 4. The blade track 148 includes a dovetailed shaped groove 179 that axially extends along the tubular body 108 on a slanted slope 180 having an acute angle with respect to the longitudinal axis $L_8$. Each of the blades 101 includes a dovetailed shaped rail (not shown) that substantially matches the dovetailed shaped groove 179 of the blade track 148 in order to slidably secure the blades 101 to the tubular body 108. When the push sleeve 115 is influenced by hydraulic pressure, the blades 101 will be extended upward and outward through a blade passage port 182 into the extended position ready for cutting the formation. The blades 101 are pushed along the blade tracks 148 until the forward motion is stopped by the tubular body 108 or the upper stabilizer block 105 being coupled to the tubular body 108. In the upward-outward or fully extended position, the blades 101 are positioned such that the cutting elements 104 will enlarge a borehole in the subterranean formation by a prescribed amount. When hydraulic pressure provided by drilling fluid flows through expandable reamer apparatus 100 is released, the spring 116 will urge the blades 101 via the push sleeve 115 and the pinned linkage 178 into the retracted position. Should the assembly not readily retract via spring force, when the tool is pulled up the borehole to a casing shoe, the shoe may contact the blades 101 helping to urge or force them down the blade tracks 148, allowing the expandable reamer apparatus 100 to be retrieved from the borehole. In this respect, the expandable reamer apparatus 100 includes a retraction assurance feature to further assist in removing the expandable reamer apparatus from a borehole. The slope 180 of blade tracks 148 is ten degrees, taken with respect to the longitudinal axis $L_8$ of the expandable reamer apparatus 100.

In addition to the upper stabilizer block 105, the expandable reamer apparatus 100 also includes a mid stabilizer block 106 and a lower stabilizer block 107. The stabilizer blocks 105, 106, 107 help to center the expandable reamer apparatus 100 in the drill hole while being run into position through a casing or liner string and also while drilling and reaming the borehole. As mentioned above, the upper stabilizer block 105 may be used to stop or limit the forward motion of the blades 101, determining the extent to which the blades 101 may engage a borehole while drilling. The upper stabilizer block 105, in addition to providing a back stop for limiting the lateral extent of the blades 101, may provide for additional stability when the blades 101 are retracted and the expandable reamer apparatus 100 of a drill string is positioned within a borehole in an area where an expanded hole is not desired while the drill string is rotating.

Also, the expandable reamer apparatus 100 may include tungsten carbide nozzles not shown. The nozzles are provided to cool and clean the cutting elements 104 and clear debris from blades 101 during drilling. The nozzles may include an O-ring seal between each nozzle and the tubular body 108 to provide a seal between the two components. The nozzles are configured to direct drilling fluid towards the blades 101 in the down-hole direction 157, but may be configured to direct fluid laterally or in the uphole direction 159.

Figure 8:
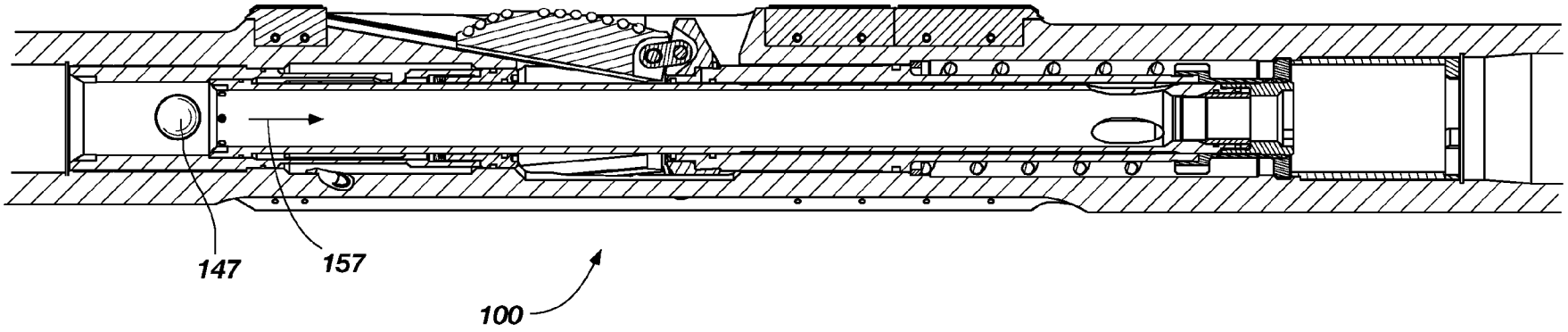
FIG. 8 shows a partial, longitudinal cross-sectional illustration of the expandable reamer apparatus of FIG. 7 in the initial tool position, receiving a ball in a fluid path.
Figure 9:
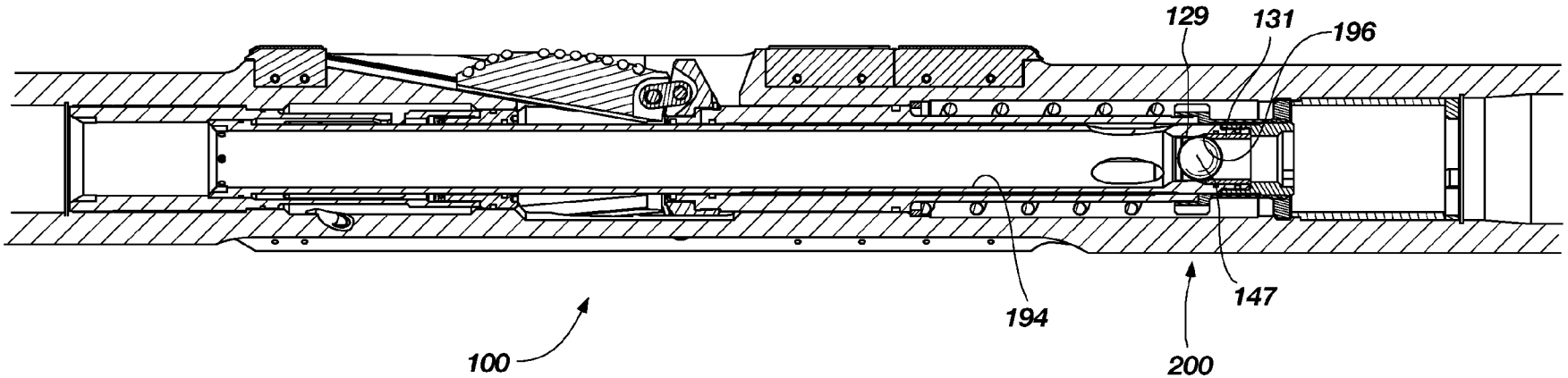
FIG. 9 shows a partial longitudinal cross-sectional illustration of the expandable reamer apparatus of FIG. 7 in the initial tool position in which the ball moves into a ball seat and is captured.

The downhole apparatus, or expandable reaming apparatus, 100 having a restriction element trap 200 is now described in terms of its operational aspects. Reference may be made to FIGS. 7-13, in particular, and optionally to FIGS. 1-6, as desirable. The expandable reamer apparatus 100 may be installed in a bottomhole assembly above a pilot bit and, if included, above or below the measurement while drilling (MWD) device. Before "triggering" the expandable reamer apparatus 100, the expandable reamer apparatus 100 is maintained in an initial, retracted position as shown in FIG. 7. For instance, the traveling sleeve 128 within the expandable reamer apparatus 100 prevents inadvertent extension of blades 101, as previously described, or activation and actuation of other operations components and is retained by the shear assembly 150 with shear screws 127 secured to the uplock sleeve 124, which is attached to the tubular body 108. While the traveling sleeve 128 is held in the initial position, the blade actuating means is prevented from directly actuating the blades 101 whether acted upon by biasing forces or hydraulic forces. The traveling sleeve 128 has, on its lower end, an enlarged end piece, the seat stop sleeve 130. This larger diameter seat stop sleeve 130 holds the dogs 166 of the lowlock sleeve 117 in a secured position, preventing the push sleeve 115 from moving upward under affects of differential pressure and activating the blades 101. The latch dogs 166 lock the latch or expandable detent 168 into a groove 167 in the inner bore 151 of the tubular body 108. When it is desired to trigger the expandable reamer apparatus 100, drilling fluid flow is momentarily ceased, if required, and a ball 147, or other fluid restricting restriction element, is dropped into the drill string and pumping of drilling fluid resumed. The ball 147 moves in the downhole direction 157 under the influence of gravity and/or the flow of the drilling fluid, as shown in FIG. 8. After a short time the ball 147 reaches the restriction element trap 200 and is forced therein by the influence of the hydraulic fluid until the ball 147 is retained by an annular portion 197 of the ball trap sleeve 129 yielding within the enlarged bore 196 of the inner bore 194 of the traveling sleeve 128 and sealed against the seat portion 195 of the plug 131 as described herein and shown in FIG. 9. The ball 147 upon being seated into the restriction element trap 200 interrupts drilling fluid flow and causes pressure to build above it in the drill string. As the pressure builds, the ball 147 may be pushed through a substantial narrower portion of the ball trap sleeve 129 until being positively located in its annular portion 197 corresponding with the enlarged bore 196 in order to securely seat the ball 147 into or against the plug 131.

Figure 10:
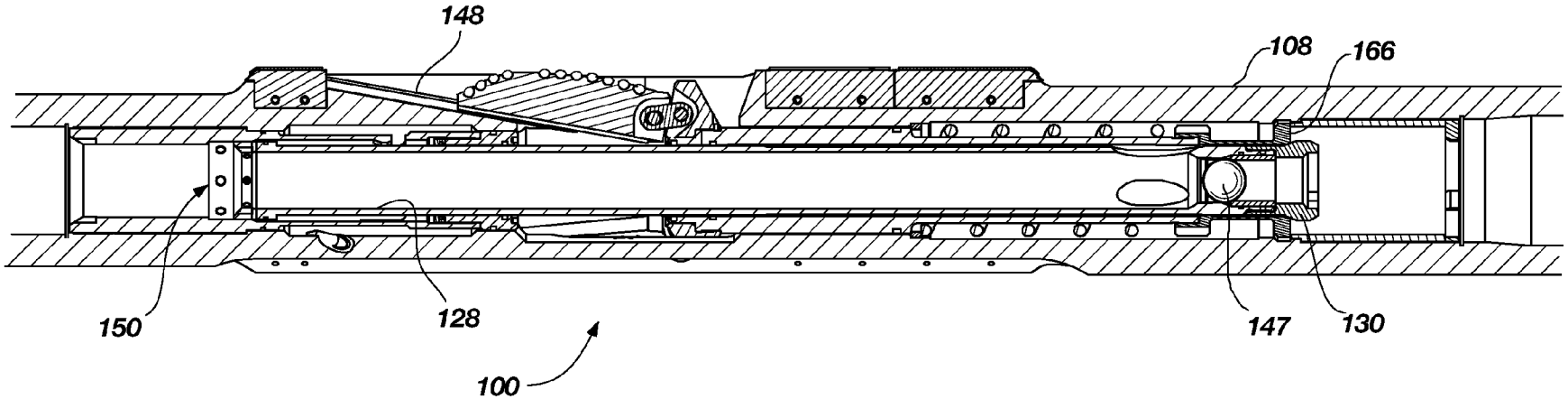
FIG. 10 shows a partial, longitudinal cross-sectional illustration of the expandable reamer apparatus of FIG. 7 in which a shear assembly is triggered as pressure is accumulated and a traveling sleeve begins to move down within the apparatus, leaving the initial tool position.

Referring to FIG. 10, at a predetermined pressure level, set by the number and individual shear strengths of the shear screws 127 (see FIG. 4) (made of brass or other suitable material) installed initially in the expandable reamer apparatus 100, the shear screws 127 will fail in the shear assembly 150 and allow the traveling sleeve 128 to unseal and move downward. As the traveling sleeve 128 with the larger end of the seat stop sleeve 130 moves downward, the latch dogs 166 of the lowlock sleeve 117 (see FIG. 2) are free to move inward toward the smaller diameter of the traveling sleeve 128 and become free of the body 108.

Thereafter, as illustrated in FIG. 11, the lowlock sleeve 117 is attached to the pressure-activated push sleeve 115 that now moves upward under fluid pressure influence through the fluid ports 173 as the traveling sleeve 128 moves downward. As the fluid pressure is increased, the biasing force of the spring 116 is overcome allowing the push sleeve 115 to move in the uphole direction 159. The push sleeve 115 is attached to the yoke 114 which is attached by pins and linkage assembly 178 to the blades 101, which are now moved upwardly by the push sleeve 115. In moving upward, the blades 101 each follow a ramp or blade track 148 to which they are mounted, via the groove 179 (shown in FIG. 4), for example.

In FIG. 12, the stroke of the blades 101 is stopped in the fully extended position by upper hard faced pads on the stabilizer block 105, for example. With the blades 101 in the extended position, reaming a borehole may commence.

As reaming takes place with the expandable reamer apparatus 100, the mid and lower hard face pads 106, 107 help to stabilize the tubular body 108 as the cutting elements 104 of the blades 101 ream a larger borehole and the upper hard face pads 105 also help to stabilize the top of the expandable reamer 100 when the blades 101 are in the retracted position.

After the traveling sleeve 128 with the ball 147 moves downward, it comes to a stop with the flow bypass or fluid ports 173 located above the ball 147 in the traveling sleeve 128 exiting against the inside wall 184 of the hard faced protect sleeve 121, which helps to prevent or minimize erosion damage from drilling fluid flow impinging thereupon. The drilling fluid flow may then continue down the bottomhole assembly, and the upper end of the traveling sleeve 128 becomes "trapped," i.e., locked, between the ears 163 of the uplock sleeve 124 and the shock absorbing member 125 of the seal sleeve 126 and the lower end of the traveling sleeve 128 is laterally stabilized by the stabilizer sleeve 122.

Figure 13:
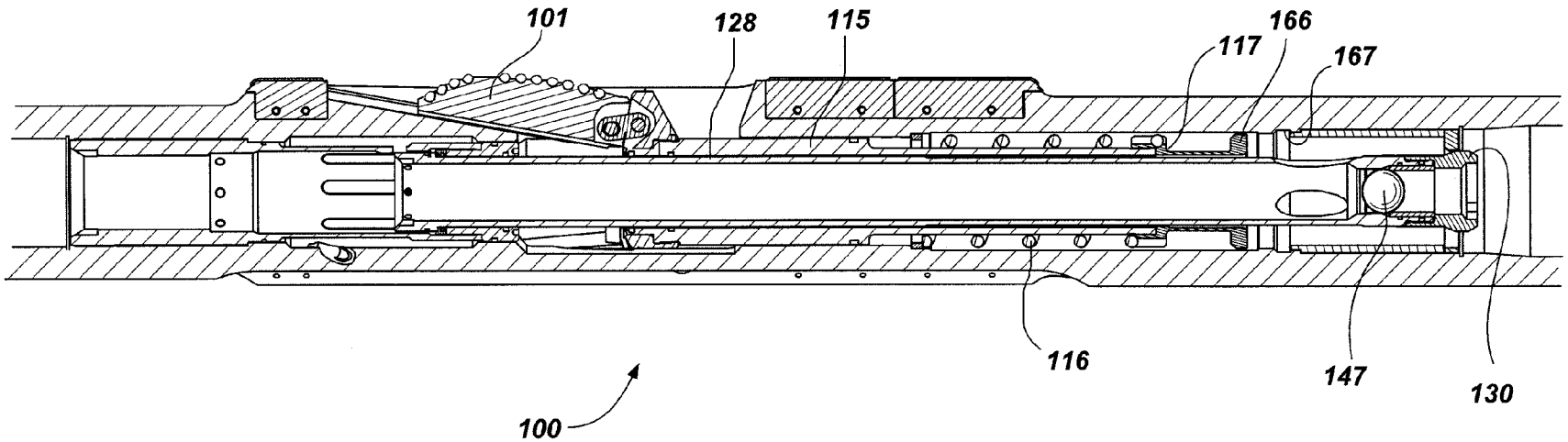
FIG. 13 shows a partial, longitudinal cross-sectional illustration of the expandable reamer apparatus of FIG. 7 in which the blades (one depicted) are retracted into a retracted position by a biasing spring when the fluid pressure is dissipated.

When drilling fluid pressure is released, the spring 116 will help drive the lowlock sleeve 117 and the push sleeve 115 with the attached blades 101 back downwardly and inwardly substantially to their original or initial position into the retracted position, see FIG. 13. However, since the traveling sleeve 128 has moved to a downward locked position, the larger diameter seat stop sleeve 130 will no longer hold the dogs 166 out and in the groove 167 and thus the latch or lowlock sleeve 117 stays unlatched for subsequent operation or activation of the push sleeve 115 or other operational components of the downhole apparatus.

Whenever drilling fluid flow is re-established in the drill pipe and through the expandable reamer apparatus 100, the push sleeve 115 with the yoke 114 and blades 101 may move upward with the blades 101 following the ramps or tracks 148 to again cut/ream the prescribed larger diameter in a borehole. Whenever drilling fluid flow is stopped, i.e., the differential pressure falls below the restoring force of the spring 116, the blades 101 retract, as described above, via the spring 116.

In aspects of the invention, the restriction element trap 200 provides a positive and robust retention of a restriction element or ball 147 within a downhole tool such as an expandable reamer apparatus 100. Furthermore, the restriction element trap 200 provides for determinate retention of a ball 147 within an actuation element, such as the traveling sleeve 128, during or prior to its release within the downhole tool. Moreover, the restriction element trap 200 provides positive retention of a ball 147 without necessitating dynamically movable parts, which is felt by some, to potentially cause premature actuation or render captioning of the restriction element in an indeterminate or unknown state.

The expandable reamer apparatus 100 may include a lower saver sub 109 shown in FIGS. 1 and 2 that connects to the lower box connection of the tubular body 108. Allowing the body 108 to be a single piece design, the saver sub 109 enables the connection between the two to be stronger (has higher makeup torque) than a conventional two piece tool having an upper and a lower connection. The saver sub 109, although not required, provides for more efficient connection to other downhole equipment or tools.

The shear screws 127 of the shear assembly 150, retaining the traveling sleeve 128 and the uplock sleeve 124 in the initial position, are used to provide or create a trigger, releasing when pressure builds to a predetermined value. The predetermined value at which the shear screws 127 shear under drilling fluid pressure within expandable reamer apparatus 100 may be 1000 psi, for example, or even 2000 psi. It is recognized that the pressure may range to a greater or lesser extent than presented herein to trigger the expandable reamer apparatus 100. Optionally, it is recognized that a greater pressure at which the shear screws 127 shears may be provided to allow the spring 116 to be conditionally configured and biased to a greater extent in order to further provide desired assurance of blade retraction upon release of hydraulic fluid. In this respect, the restriction element trap 200 may retentively receive a restriction element, such as a ball 147, with a pressure substantially less than pressure required for releasing the shear assembly 150 while conditionally providing retention of the restriction element to pressures greatly exceeding the pressure required for releasing the shear assembly 150. Furthermore, the restriction element trap 200 provides for retaining a restriction element under reverse pressure conditions. It is recognized the restriction element trap 200 may be configured for retentively receiving a restriction element for differing hydraulic pressure requirements, and may be configured to have retention characteristics chosen in relationship to a shear assembly 150 of an actuation element, such as a traveling sleeve 128.

In another aspect of the invention, the restriction element trap 200 within an actuation element may retentively receive a restriction element in order to cause activation of the actuation element by hydraulic fluid pressure in response to occlusion of a flow path therethrough, allowing the actuation element to be displaced in an axial downhole direction and thereafter exposing an operational component to a diverted hydraulic fluid in order to actuate the operational component in an axial upward direction, an axial downward direction, a laterally outward direction or other direction. In this respect, the actuation element may shield an operational component from hydraulic fluid pressure or premature operation until a restriction element is positively retained and the actuation element has been displaced.

While particular embodiments of the invention have been shown and described, numerous variations and other embodiments will occur to those skilled in the art. Accordingly, it is intended that the invention only be limited in terms of the appended claims and their legal equivalents.

What is claimed is:

1. A downhole apparatus for engaging a borehole in a subterranean formation, comprising:

a tubular body having a longitudinal axis and defining a first bore;

an actuation element defining a second bore, the actuation element slidably positioned within the first bore of the tubular body and configured to selectively retain an operable component of the downhole apparatus in an initial position; and a restriction element trap fixedly retained within the second bore of the actuation element for retentively receiving a restriction element, the restriction element trap comprising:

a ball trap sleeve; and a tubular plug positioned in a downhole direction from the ball trap sleeve and having a portion thereof positioned adjacent to a portion of the ball trap sleeve to permanently prohibit movement of the ball trap sleeve in a downhole direction relative to the actuation element, wherein at least a majority of the ball trap sleeve and at least a majority of the tubular plug are positioned in the actuation element, and wherein the actuation element comprises an enlarged bore exhibiting an inner diameter proximate to the restriction element trap that is greater than an outer diameter of a portion of the restriction element trap to enable the portion of the restriction element trap to yield outwardly toward the actuation element upon receiving a restriction element.

2. The downhole apparatus of claim 1, wherein the downhole apparatus is an expandable reamer apparatus and the actuation element is a traveling sleeve of the expandable reamer apparatus.

3. The downhole apparatus of claim 1, wherein the restriction element trap is positioned in a downhole end of the actuation element.

4. The downhole apparatus of claim 1, wherein the ball trap sleeve and the tubular plug are coaxially aligned.

5. The downhole apparatus of claim 1, further comprising a seal between the actuation element and the tubular plug.

6. The downhole apparatus of claim 1, wherein the inner diameter of the actuation element is configured to enable the portion of the restriction element trap to permanently retain the restriction element within the restriction element trap.

7. The downhole apparatus of claim 1, wherein the enlarged bore of the actuation element is substantially located corresponding to axially adjacent portions of the ball trap sleeve and the tubular plug.

8. The downhole apparatus of claim 7, wherein a portion of the ball trap sleeve comprises a ductile material and wherein the enlarged bore enables the portion of the ball trap sleeve to yield outwardly into the enlarged bore of the actuation element upon receiving a restriction element therein.

9. The downhole apparatus of claim 1, wherein the ball trap sleeve comprises a thin-walled metal conduit and the tubular plug comprises a cylindrical tetrafluoroethylene tube.

10. The downhole apparatus of claim 1, wherein the operable component is located and configured for operation responsive to exposure to drilling fluid pressure within a drilling fluid flow path extending through the first bore and the second bore in response to movement of the actuation element.

11. The downhole apparatus of claim 10, further comprising at least one nozzle formed in the tubular body for directing drilling fluid and wherein the actuation element is configured to selectively isolate the at least one nozzle from exposure to drilling fluid passing through the drilling fluid flow path.

12. The downhole apparatus of claim 10, wherein the operable component is a push sleeve disposed within the first bore of the tubular body and configured to move axially along the longitudinal axis of the tubular body responsive to exposure to a pressure of drilling fluid passing through the drilling fluid flow path.

13. The downhole apparatus of claim 1, wherein the actuation element is axially retained in an initial position within the first bore of the tubular body by a shear assembly.

14. The downhole apparatus of claim 1, wherein the restriction element trap is configured to prohibit movement of the ball trap sleeve in the downhole direction relative to the actuation element before retentively receiving the restriction element and after retentively receiving the restriction element.

15. A restriction element trap for use with an actuation element for retentively receiving a restriction element, comprising:

a tubular body having a longitudinal axis and an inner bore, and configured to be slidably retained in a downhole apparatus and configured for use with the downhole apparatus to selectively retain an operable component in an initial position within the tubular body;

a drilling fluid flow path extending through the inner bore of the tubular body;

a ball trap sleeve; and a plug coaxially aligned with the ball trap sleeve and an inner portion of the plug directly engaging an outer portion of the ball trap sleeve, the ball trap sleeve and the plug configured for retentively receiving a restriction element, wherein the ball trap sleeve is fixedly retained within the inner bore of the tubular body before receiving the restriction element by direct engagement with the plug and wherein at least a majority of the ball trap sleeve and at least a majority of the plug are positioned in the tubular body.

16. The restriction element trap of claim 15, further comprising a seal positioned between the tubular body and the plug and wherein at least a majority of the ball trap sleeve and at least a majority of the plug are positioned in the tubular body.

17. The restriction element trap of claim 15, wherein a portion of the inner bore of the tubular body comprises an enlarged bore located proximate to portions of the ball trap sleeve and the plug, the portion of the inner bore of the tubular body comprising the enlarged bore exhibiting an inner diameter configured to enable the ball trap sleeve to yield outwardly toward the tubular body upon receiving a restriction element in order to permanently retain the restriction element within the restriction element trap.

18. The restriction element trap of claim 17, wherein the inner diameter of the enlarged bore is greater than an outer diameter of the ball trap sleeve.

19. The restriction element trap of claim 15, wherein the ball trap sleeve comprises a thin-walled metal conduit and at least a portion of the plug comprises a cylindrical-shaped tetrafluoroethylene component.

20. An expandable reamer apparatus for enlarging a borehole in a subterranean formation, comprising:

a tubular body having a longitudinal axis and an inner bore;

a drilling fluid flow path extending through the inner bore;

a push sleeve configured to move axially along the longitudinal axis of the tubular body responsive to exposure to a pressure of drilling fluid passing through the drilling fluid flow path;

a traveling sleeve positioned within the inner bore of the tubular body and configured to selectively retain the push sleeve of the expandable reamer apparatus in an initial position; and a restriction element trap fixedly retained within a lower portion of the traveling sleeve, and sized and configured for retentively receiving a restriction element, the restriction element trap comprising a ball trap sleeve and a tubular plug adjacent to the ball trap sleeve;

wherein the traveling sleeve exhibits an inner diameter proximate to a portion of the restriction element trap that is greater than an outer diameter of the restriction element trap to enable the restriction element trap to yield outwardly toward the traveling sleeve upon receiving a restriction element in order to permanently retain the restriction element within the restriction element trap against a seat portion of the tubular plug.

21. The expandable reamer apparatus of claim 20, wherein the ball trap sleeve and the tubular plug are coaxially aligned.

22. The expandable reamer apparatus of claim 20, wherein the restriction element trap is sized and configured for retentively receiving a restriction element moving in a downhole direction.

23. The expandable reamer apparatus of claim 20, wherein the restriction element trap is sized and configured for retentively receiving a restriction element moving in a downhole direction under pressure of drilling fluid within the drilling fluid flow path of a lesser magnitude than drilling fluid pressure within the drilling fluid flow path required for releasing the traveling sleeve.

24. The expandable reamer apparatus of claim 20, wherein the restriction element trap is sized and configured for retentively receiving a restriction element moving in a downhole direction under pressure of drilling fluid within the drilling fluid flow path of a lesser magnitude than drilling fluid pressure within the drilling fluid flow path required to release the traveling sleeve, and wherein the restriction element trap is sized and configured for securing a retentively received restriction element moving in a downhole direction under pressure of drilling fluid within the drilling fluid flow path substantially greater than the pressure required to release the traveling sleeve.

25. The expandable reamer apparatus of claim 20, wherein the restriction element trap is sized and configured for retentively receiving a restriction element moving in a downhole direction under pressure of drilling fluid within the drilling fluid flow path and for retaining the received restriction element against movement in an uphole direction under substantially the same extent of pressure.

26. A method of activating a downhole apparatus within a borehole of a subterranean formation, comprising:

disposing a downhole apparatus including an actuation element having a bore formed therein within the subterranean formation;

flowing drilling fluid through the downhole apparatus via a drilling fluid flow path extending through an interior bore of the downhole apparatus and the bore of the actuation element;

disposing a restriction element into the drilling fluid;

receiving the restriction element carried by the drilling fluid flowing through the drilling fluid flow path in the bore of the actuation element;

retaining the restriction element within the bore of the actuation element to partially occlude the drilling fluid flow path through the actuation element, comprising:

forcing the restriction element into a ball trap sleeve disposed within the bore of the actuation element with the drilling fluid; and partially deforming the ball trap sleeve with the restriction element to permanently retain the restriction element within the ball trap sleeve; and releasing the actuation element for movement during or after occlusion of the fluid flow path.

27. The method of claim 26, wherein forcing the restriction element into a ball trap sleeve disposed within the bore of the actuation element with the drilling fluid is effected at a drilling fluid pressure substantially lower than a drilling fluid pressure required for releasing the actuation element.

* * * * *